US006148739A

United States Patent [19]

Martin

[11] Patent Number: 6,148,739

[45] **Date of Patent: *Nov. 21, 2000**

[54] ADJUSTABLE ERGONOMIC SUPPORT FOR COMPUTER KEYBOARDS

[75] Inventor: Michael Martin, Whitehouse Station, N.J.

[73] Assignee: 1320236 Ontario Inc., Canada

[ * ] Notice: This patent is subject to a terminal disclaimer.

[21] Appl. No.: 09/306,622

[22] Filed: May 6, 1999

Related U.S. Application Data

[63] Continuation of application No. 08/731,842, Oct. 21, 1996, abandoned, which is a continuation of application No. 08/198,890, Feb. 18, 1994, Pat. No. 5,582,375, which is a continuation-in-part of application No. 07/871,108, Apr. 20, 1992, Pat. No. 5,351,897.

[51] Int. Cl.[7] ..... A47B 37/00

[52] U.S. Cl. ..... 108/50.01; 248/918

[58] Field of Search ..... 108/1, 10, 6, 8, 108/50.01, 50.02, 143, 141; 248/918, 118.3, 118, 118.1

[56] References Cited

U.S. PATENT DOCUMENTS

| | | | |
|---|---|---|---|
| 1,248,842 | 12/1917 | Gaver | 108/8 |
| 2,710,051 | 6/1955 | Greenberg | 108/6 |
| 3,830,352 | 8/1974 | Kolpek . | |
| 3,991,961 | 11/1976 | Platzer, Jr. . | |
| 4,616,798 | 10/1986 | Smeenge et al. . | |
| 4,688,862 | 8/1987 | Fowler et al. . | |
| 4,706,919 | 11/1987 | Soberalski et al. . | |
| 4,709,972 | 12/1987 | LaBudde et al. . | |
| 4,717,112 | 1/1988 | Pirkle | 108/143 X |
| 4,913,390 | 4/1990 | Berke . | |
| 4,949,650 | 8/1990 | Allard . | |
| 4,976,407 | 12/1990 | Schwartz et al. . | |
| 5,037,054 | 8/1991 | McConnell . | |
| 5,048,784 | 9/1991 | Schwartz et al. . | |
| 5,104,073 | 4/1992 | Van Beek et al. . | |
| 5,154,390 | 10/1992 | Bain et al. . | |
| 5,174,223 | 12/1992 | Nagy et al. | 108/50.01 |
| 5,211,367 | 5/1993 | Musculus . | |
| 5,257,767 | 11/1993 | McConnell . | |
| 5,351,897 | 10/1994 | Martin . | |
| 5,405,204 | 4/1995 | Ambrose . | |
| 5,513,824 | 5/1996 | Leavitt et al. . | |
| 5,582,375 | 12/1996 | Martin . | |

FOREIGN PATENT DOCUMENTS

WO9213722 8/1992 WIPO .

OTHER PUBLICATIONS

Brochure entitled "Position Control Solutions—Customize Any Workstation For Comfort & Functionality", Weber Knapp Company, Copyright 1992.

E. Helmetsie, "Mediating the Space Between Workers and Tools", Innovation, Fall 1992.

News Release entitled "New Keyboarding System Designed to Help Prevent Carpal Tunnel Syndrome Uses High–Strength, Glass–Filled Nylon for Key Structural Parts", Miles–Polymers Division, Mar. 8, 1993.

Stack, Barbara, Keyboard RSI: The Practical Solution, 1987, pp. 1–78.

O'Malley, Brian, "Keyboard–Associated Carpal Tunnel Syndrome", date unknown, pp. 1–7.

Stack, Barbara, Repetitive Strain Injury–Prevention and Rehabilitation, *Preprints of International Conference on Ergonomics, Occupational Safety and Health and the Environment*, vol. 1, Australian Darling Downs Institute of Advanced Education, Oct. 24–28, 1988, pp. 444–453.

Patkin, Michael, Problems of Computer Workers: Lessons from the Australian Debate, Work With Display Units 89, 1990, pp. 547–555.

*Primary Examiner*—Jose V. Chen

*Attorney, Agent, or Firm*—Lerner, David, Littenberg, Krumholz & Mentlik, LLP

[57] ABSTRACT

A keyboard positioning system, either alone or in combination with other computer aids, which is ergonomic in design and allows for height adjustments to accommodate operators of different anatomical sizes, yet presets the angle of palm rest and angle of keyboard tray to a wrist neutral position to ensure the proper positioning of the operator's hands, wrist and fingers to greatly lessen or eliminate stress and strain injuries.

12 Claims, 8 Drawing Sheets

ADJUSTABLE ERGONOMIC SUPPORT FOR COMPUTER KEYBOARDS

RELATED APPLICATIONS

This application is a continuation of U.S. Ser. No. 08/731,842 filed Oct. 21, 1996 now abandoned, which is a continuation of U.S. Ser. No. 08/198,890, filed Feb. 18, 1994 which issued as U.S. Pat. No. 5,582,375, which is a continuation-in-part of U.S. Ser. No. 07/871,108, filed Apr. 20, 1992 which issued as U.S. Pat. No. 5,351,897.

BACKGROUND OF THE INVENTION

Field of the Invention

This invention relates to an improved adjustable support platform for support of a computer keyboard, the support being fully adjustable in height for individuals of varying sizes, either right-handed or left-handed, the support having a preset angle with respect to a horizontal plane to ensure support at a neutral wrist angle and a neutral finger angle position.

The advent of the personal computer in the early 1980's resulted in a total revamping and change in the office environment. Data processing and word processing could now be accomplished at much greater speeds and efficiencies. The keyboard developed for use with personal computers evolved from the technology associated with manual typewriters which required a posture suited to a slower typing rate and heavy downward stroke on the keys. Further, the manual machines and even the later generation electric typewriters provided for frequent rest periods for the operator. Fingers could rest on the keys without causing them to actuate and rests were further provided by interruptions, such as carriage returns, paper changes and manual error corrections. These short rests or mini breaks allow time for recovery from any fatigue, trauma or tension of the lower arms, wrist and fingers.

With the advent of the personal computer, office place injuries in the form of carpal tunnel syndrome have more than doubled. This trauma occurs when the nerve and tissues in the carpal tunnel within the wrist are compressed by the bones and ligaments. It results in numbness, tingling and pain in the hand and fingers that migrates to the elbow and shoulders. Corrective surgery to correct this malady is required in over 50% of the cases and in some instances, must be repeated a second time within 18 months. One culprit identified in the rise of carpal tunnel syndrome is the computer keyboard and its positioning vis-à-vis the posture of the operator. The computer and the associated keyboard have eliminated the mini or micro breaks that the operator experienced in using manual machines or late model electric typewriters. There is no longer a carriage return. Paper changes are not required and manual error corrections are performed through further use of the keyboard. Feather-touch keys on the keyboards reduce the amount of force required to actuate the keys and mandate that the operator cannot rest their fingers on the keys. Productivity is increased dramatically as a result of the development of the personal computer. Typing speeds in the form of strokes per hour have quadrupled since all corrections and directions are now performed by keyboard functions with directions to the personal computer. However, the overall method of data entry has not significantly improved. Computer operators continue to assume the traditional typing position in which the wrists are flexed. This position is acceptable for manual typewriters where the mini breaks occur in the data entry process, but is not suitable for utilizing computer keyboards for data entry where the speed of data entry has been greatly increased.

There have been many attempts to develop a keyboard support which would combine several advantages for the keyboard operator. These developments include mounts which allow the keyboard support to be slipped under the desktop, supports which allow the raising and lowering of the keyboard, and in some instances, attempts have been made to provide for the tilting of the keyboard. Examples of these developments can be found in the following U.S. Pat. Nos. 5,037,054; 5,040,760; 5,031,867; 4,988,066; 4,913,390; 4,826,123; 4,776,284; 4,706,919; 4,691,888; 4,635,893; and 4,616,798. None of the above patents address the key issues with respect to the positional relationship of the keyboard in both horizontal and vertical planes through the relationship of the positioning of the operator's forearms, wrists and fingers.

The present inventor has appreciated the advantages of an ergonomically-designed support for the keyboard and other related computer aids including document holders in which the position of the operator's forearms, wrists and fingers are maintained in a neutral position with the keyboard support in a slightly tilted, non-horizontal plane, the rear of the keyboard being slightly lower than the front of the keyboard thereby eliminating any flexation or extension of the forearms, wrists and fingers of the operator.

The present inventor has also improved the keyboard support assembly to preset the angle of the palm rest and to preset the angle of the keyboard tray to cover a wide range of anthropometric hand and finger sizes to ensure that the angle of the palm rest and keyboard tray remain in a neutral position vis-a-vis the operator. Active height adjustment would be available to accommodate the physical parameters of the individual using the keyboard and an active fine adjustment mechanism would be available to accommodate extreme variations and diversities in the anthropometric range.

The ability to preset the angle of the palm rest and keyboard tray, yet allow height adjustment and fine adjustment of this angle is accomplished through a novel adjustment means cooperative between the keyboard tray and the support means securing the keyboard tray to the desk or computer stand.

OBJECT OF THE INVENTION

An object of the present invention is to provide for a novel computer keyboard support assembly with preset keyboard support and palm rest angles to ensure maintenance of a neutral wrist position by the operator.

Another object of the present invention is to provide for a novel keyboard support assembly that permits height adjustments to accommodate individuals of varying physical parameters.

A further object of the present invention is to provide for a novel keyboard support assembly in which the preset keyboard and palm rest angles are broad enough to cover a wide range of anthropometric parameters.

A still further object of the present invention is to provide for a novel keyboard support assembly in which a fine adjustment is available in order to accommodate extreme variations and diversities in anthropometric range.

A still further object of the present invention is to provide a novel method of positioning a keyboard with respect to a work surface so that the keyboard user's wrists will be in a substantially neutral position when the keyboard user is in an operating position relative to the keyboard.

SUMMARY OF THE INVENTION

The present invention is directed towards a keyboard positioning system, either alone or in combination with other computer aids, such as a document holder, mouse pad and writing surface, which is ergonomic in design and allows for height adjustments to accommodate operators of different anatomical sizes, yet which presets the palm rest and the keyboard support at a negative slope to ensure that the operator's wrists and fingers remain in a neutral position when operating the system, thereby greatly lessening or eliminating the possibility of the development of carpal tunnel syndrome. The keyboard positioning system would preset the angle of the palm rest and the angle of the keyboard to cover the broadest anthropometric range, yet would still allow for fine adjustment in order to accommodate extreme variations in the anthropometric range, the keyboard support and support means being cooperable to ensure the maintenance of the neutral position even when the keyboard support is adjusted for varying heights.

The keyboard support assembly provides the keyboard support to be mounted for pivotal movement relative the work surface, so as to dispose the upper surfaces of the keyboard support at various angular orientations relative the horizontal. The keyboard support assembly includes a locking mechanism to lock the keyboard support in desired angular orientations relative the horizontal, however, with the assembly configures such that the keyboard support when locked is only in negative tilt orientations. Negative tilt orientations are those in which a rear of the keyboard away from a user is at least marginally lower than the front of the keyboard.

The keyboard support assembly also preferably provides for the keyboard to be mounted for vertical movement relative the work surface so as to vary the relative height of the keyboard support relative the work surface.

The preferred embodiments illustrated in this application show an exemplary preferred arrangement which mounts the keyboard for pviotal movement with locking limited to be in negative tilt orientations and for vertical movement. Many other mounting, locking and limiting mechanisms may be utilized in substitution for the illustrated mechanisms as will be apparent to persons skilled in the art, and achieve the aspect of the invention of providing a keyboard support mechanism which in a practical manner is adjustable for tilt angle and, preferably, height yet which in normal use and adjustment by a user will only be locked into a negative tilt orientation.

To provide tilting, a preferred tilting mechanism has the keyboard support member pivotably mounted to a bracket member for pivoting about an axis or axle as disclosed in the drawings. However, various other mechanisms and arrangements can provide tilting. Similarly, various mechanisms will be appreciated to provide height adjustment and/or combined tilting and height adjustment.

The preferred embodiments teach a limiting mechanism to maintain the keyboard support disposed in negative tilt orientations. Various other tilt limiting mechanisms could be used without departing from the present invention. The limit mechanism should preferably at the least prevent the keyboard support from becoming locked in orientations other than negative tilt orientations.

The preferred embodiments teach a locking mechanism to lock the keyboard support in desired positions. Either the same or different locking mechanisms may be provided to lock the keyboard support at desired angular orientations and desired height. Various other locking mechanisms could be used without departing from the present invention.

In one aspect, the present invention provides an adjustable support assembly for supporting a keyboard, the support assembly comprising a support platform having an upper surface, a front edge and a rear edge, said front edge being closer to the keyboard user than said rear edge when the keyboard user is in an operating position relative the keyboard, the support assembly including a bracket assembly for mounting the support platform to a work surface, the support platform being movably mounted to the bracket member for movement through a range of positions including angular movement of said support platform relative to said bracket assembly to locate the front and rear edges of the support platform at different heights relative to each other, a locking mechanism for locking said support platform in fixed relation to said bracket assembly within said range of positions, the improvement comprising a limiting mechanism for limiting angular movement of said support platform relative to said bracket assembly in said locked condition so that said support platform in said locked condition is always oriented with said front edge higher than said rear edge.

In another aspect, the present invention provides an assembly wherein said bracket member comprises a first bracket element mounted to the work surface, a second bracket element pivotably mounted to the first bracket member for pivoting about a horizontal axis, the support platform mounted to the second bracket element for adjustment of the distance of the support platform from the horizontal axis.

In yet another aspect, the present invention provides a method of positioning a keyboard with respect to a work surface so that the keyboard user's wrists will be in a substantially neutral position when the keyboard user is in an operating position relative to said keyboard, said method comprising the steps of:

mounting said keyboard on a support platform having a front edge and a rear edge, said front edge being closer to the keyboard user in said operating position than said rear edge;

moving said support platform relative to said work surface through a range of positions between a lower position and an upper position;

locking said support platform at a selected position within said range of positions; and limiting angular movement of said support platform relative to said work surface in said selected position so that said support platform in said selected position is always oriented with said front edge higher than said rear edge.

BRIEF DESCRIPTION OF THE DRAWINGS

The objects of the invention, together with other advantages will become apparent, particularly when taken in light of the following drawings wherein.

DETAILED DESCRIPTION OF THE DRAWINGS

Figure 1:
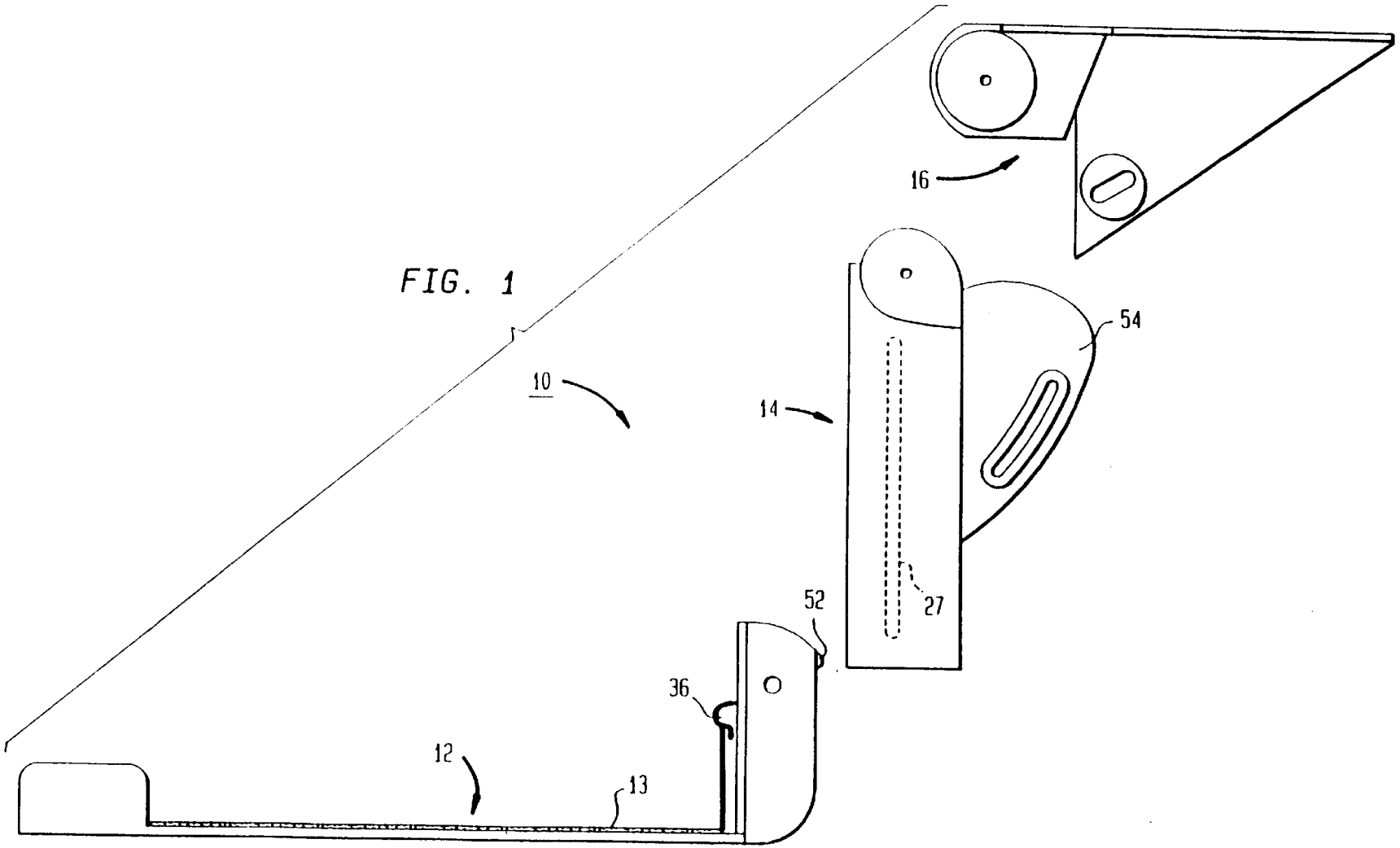
FIG. 1 is an exploded side view of the keyboard support assembly illustrating the three primary components.

The adjustable ergonomic keyboard support assembly 10 is comprised of three (3) primary elements; the keyboard support 12, the height adjustment member 14, and the horizontal mounting member 16. The height adjustment member 14 and the horizontal mounting member 16 together constitute a bracket assembly for mounting the keyboard support 12 to a work surface. These three elements are illustrated in FIG. 1 which is a side clevational exploded view of keyboard support assembly 10.

Figure 2:
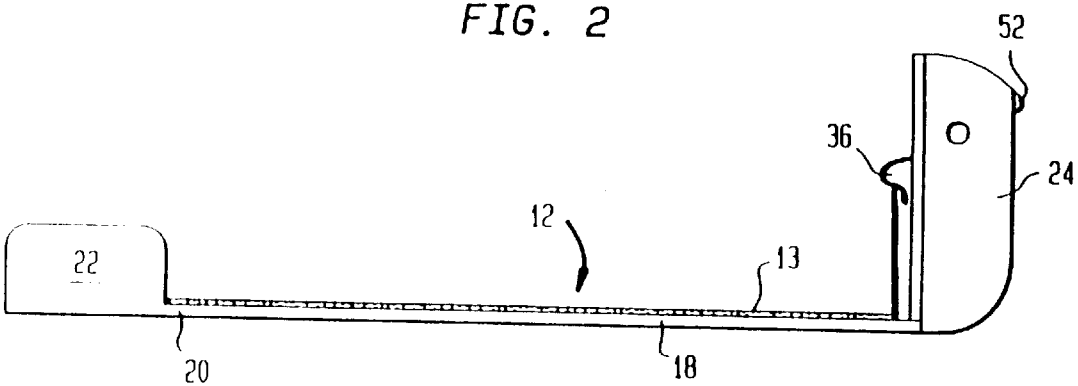
FIG. 2 is a side elevational view of the keyboard support.

As illustrated in FIG. 1 and FIG. 2, which is a side elevational view of keyboard support 12, the keyboard support consists of a planar support base 18 which generally subscribes to the shape and dimensions of a standard computer keyboard. Base 18 has formed on its front end 20 a palm and wrist support 22. Palm and wrist support 22 is designed to support the wrist and palm of the operator in the preferred neutral position as discussed in detail hereafter. Palm and wrist support 22 is configured to the correct height in order to provide this neutral support for the operator when the computer keyboard is positioned on base 18 and its longitudinal edge is in proximate contact with the palm and wrist support 22.

Figure 3:
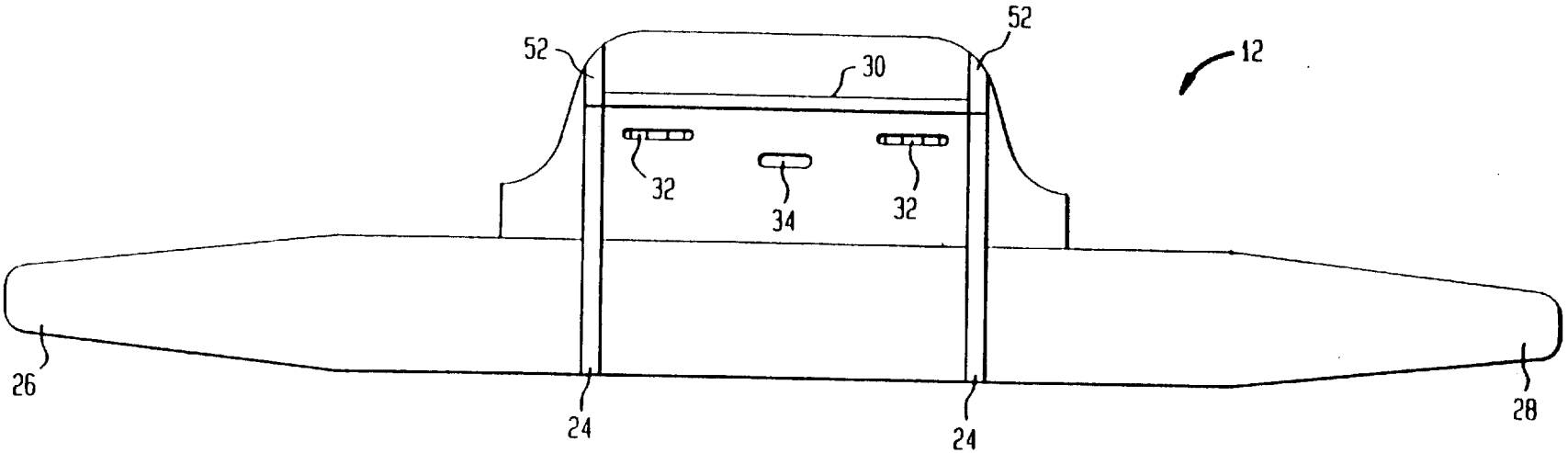
FIG. 3 is a rear elevational view of the keyboard support.

Keyboard support 12 has two upstanding parallel bracket supports 24 positioned equidistant from ends 26 and 28 of keyboard support 12. Brackets 24 are best illustrated with respect to FIG. 3 which is a rear view of keyboard support 12. Brackets 24 are designed for cooperation with height adjustment member 14. Residing between brackets 24 is a positioning rod 30 which is cooperable with a pair of vertical slots 25 and 27 formed on height adjustment member 14 as discussed hereafter.

There is further positioned on the rearward side of keyboard support 12, a pair of locating bosses 32. These locating bosses 32 are in the form of horizontally-formed protrusions on the rear face of keyboard support 12 and are cooperable with complementary recesses 48 in height adjustment member 14 as described hereafter. In addition to locating bosses 32, the rear face of keyboard support 12 has a locking cross member 34 which is rotated by actuating mechanism 36 on the front side of the rear face of keyboard support 12. As will be explained further below, through the manipulation of actuating mechanism 36, locking cross member 34 may be moved between a locked position in which it securely engages height adjustment member 14, and a released position in which it is no longer engaged with height adjustment member 14. Thus, once keyboard support member 12 has been positioned at the desired height with locating bosses 32 in the appropriate recesses in height adjustment member 14, actuating member 36 can be operated to place locking cross member 34 in the locked position to engage locking cross member 34 with height adjustment member 14 and securely hold the components in this selected position.

Figure 4:
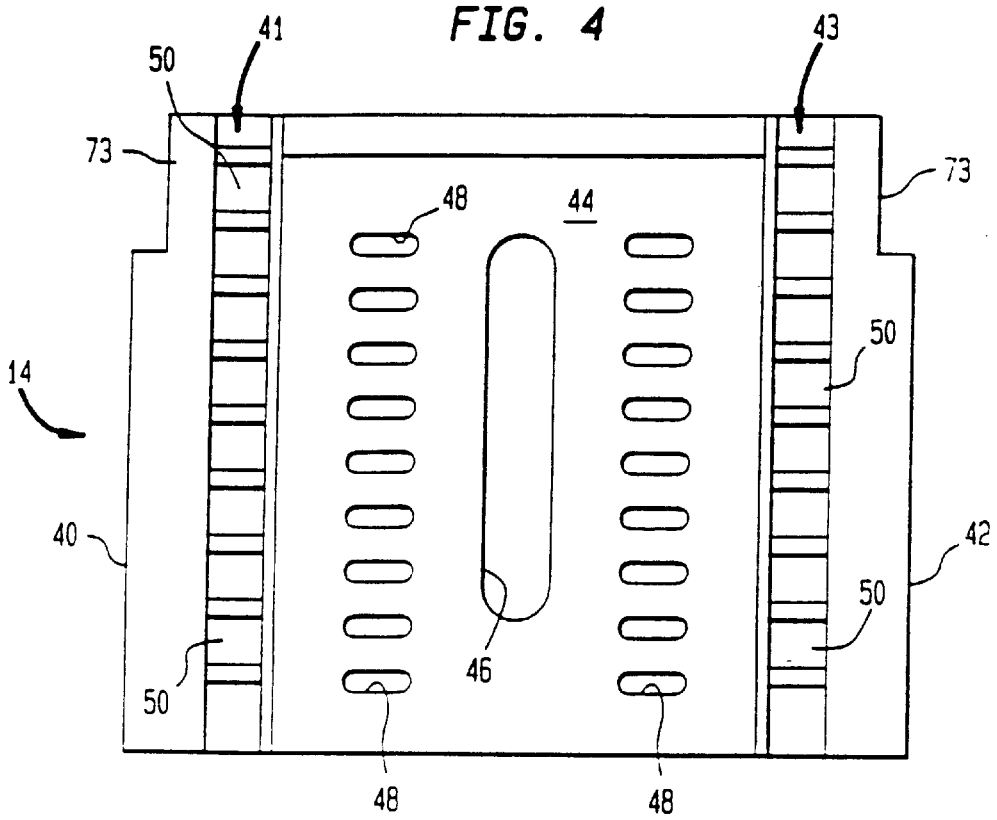
FIG. 4 is a front elevational view of the height adjustment member.

A front view of height adjustment member 14 is illustrated in FIG. 4. Height adjustment member 14 is comprised of two (2) end brackets 40 and 42 which are spaced by channels 41 and 43, respectively, from a forward face 44. Height adjustment member 14 is generally rectangular in shape having a vertical slot 46 centrally positioned thereon, which vertical slot accommodates locking cross member 34 of keyboard support 12 in a slidable manner.

The forward face 44 of height adjustment member 14 has two rows of vertically aligned horizontal recesses 48 which in turn are cooperable with locating bosses or protrusions 32 on the rear face of keyboard support 12.

Additionally, height adjustment member 14 has a second pair of vertically aligned horizontal recesses 50 positioned along the bottoms of channels 41 and 43. These recesses cooperate with complementary locating elements 52 formed on the upper rearward portions of brackets 24 of keyboard support 12.

Figure 6:
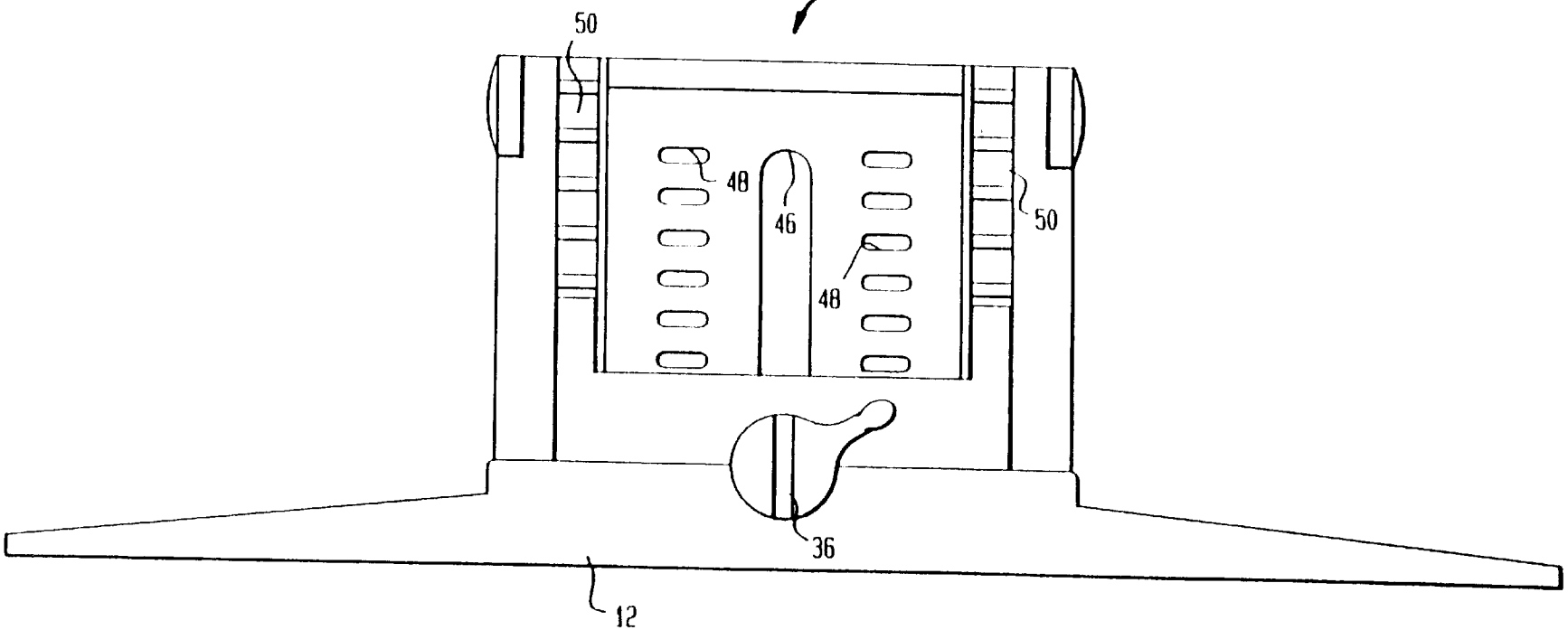
FIG. 6 is a front elevational view showing the cooperation between the keyboard support and the height adjustment member.
Figure 11:
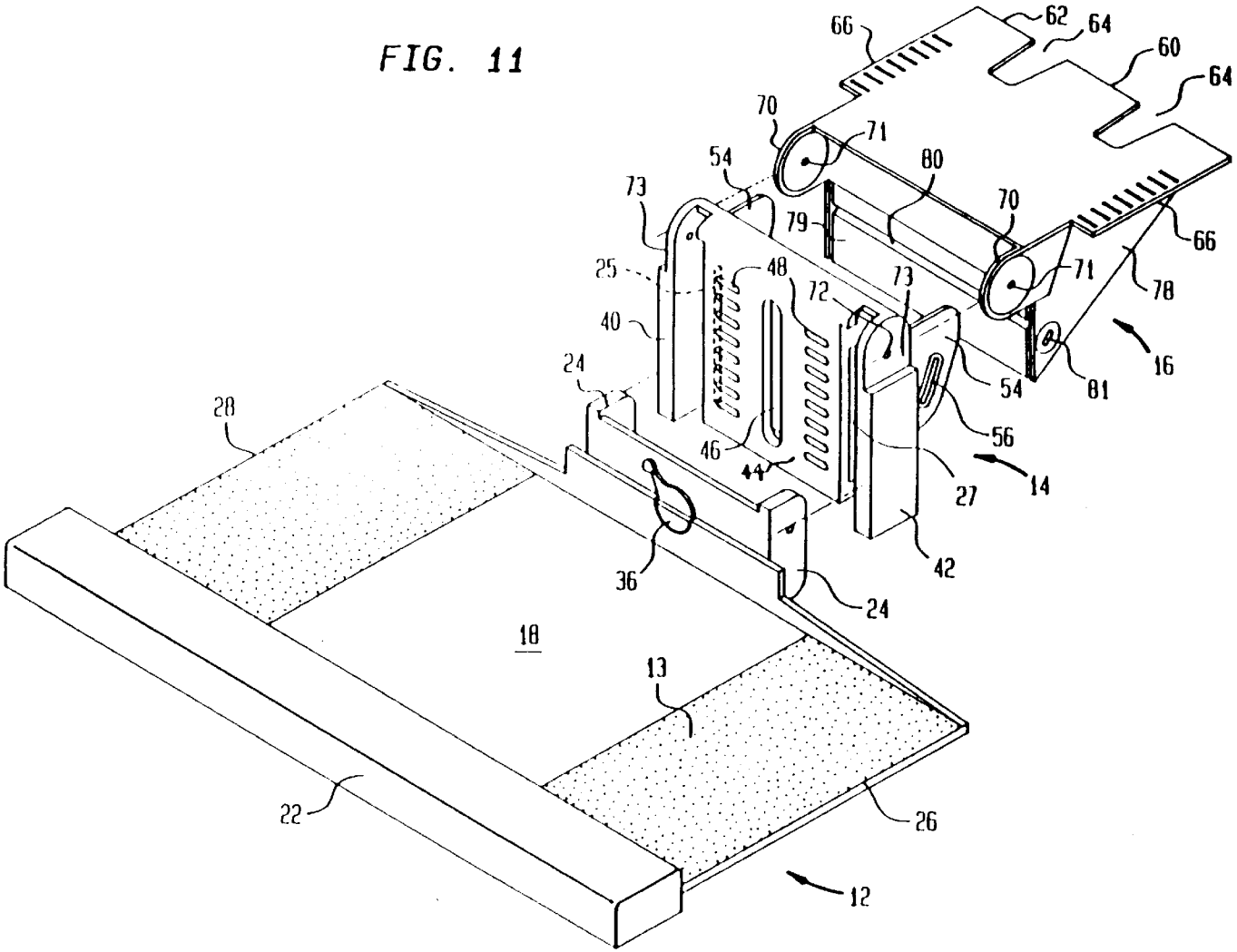
FIG. 11 is a front exploded perspective view of the keyboard support.
Figure 12:
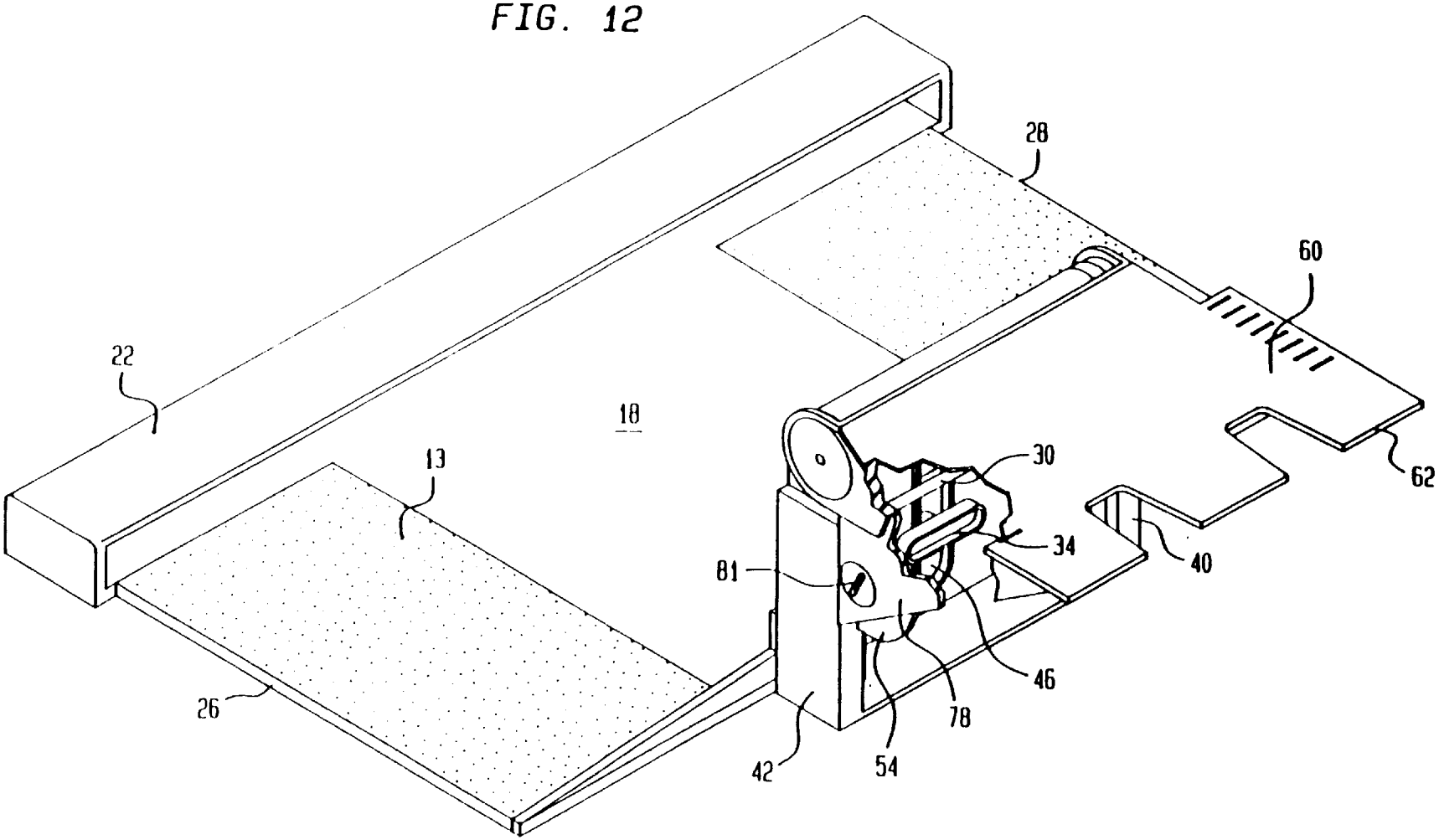
FIG. 12 is a rear perspective view of the keyboard support in assembled condition.

In operation, actuating mechanism 36 may be turned from an opened position to a fully locked position. In the opened position, keyboard support 12 may be adjusted upwardly or downwardly in relationship to height adjustment member 14 by means of the movement of guide rod 30 in vertical slots 25 and 27. This is accomplished by rotating the front edge 20 of the keyboard support upwardly with respect to height adjustment member 14. This movement disengages locating bosses 32 on keyboard support 12 from recesses 48 on the front face of height adjustment member 14, and also disengages locating element 52 from recesses 50 in channels 41 and 43. Keyboard support 12 may then be slidably moved upwardly or downwardly to obtain the desired height, with guide rod 30 traveling within mounting slots 25 and 27 to hold keyboard support 12 in assembled relationship with height adjustment member 14. It is then rotated downwardly such that the locating bosses 32 on its rearward face engage complementary recesses 48 on the front face of height adjustment member 14. Simultaneously, locating elements 52 on brackets 24 of keyboard support 12 would engage complementary recesses 50 on height adjustment member 14. Actuating mechanism 36 would then be moved from the opened to the locked position. This in turn would rotate locking cross member 34 from a vertical orientation; the orientation it is found when in the opened position, to a horizontal or locked position in which it spans slot 46 in height adjustment member 14 thereby locking the keyboard support in relationship to the height adjustment member. This relationship may best be illustrated in FIG. 6 which is a front view of keyboard support 12 in cooperation with height adjustment member 14 showing the manner in which keyboard support 12 is ratchctly engaged with height adjustment member 14. In FIG. 6, actuating mechanism 36 is positioned in the opened position (with cross member 34 oriented vertically) which would allow for the upward or downward movement of keyboard support 12. Once the correct height had been obtained, the actuating mechanism 36 would be rotated approximately 90° to the locked position (shown in FIG. 11) which in turn would cause cross member 34 to rotate to a horizontal orientation across slot 46 and into locking engagement with height adjustment member 14.

Figure 5:
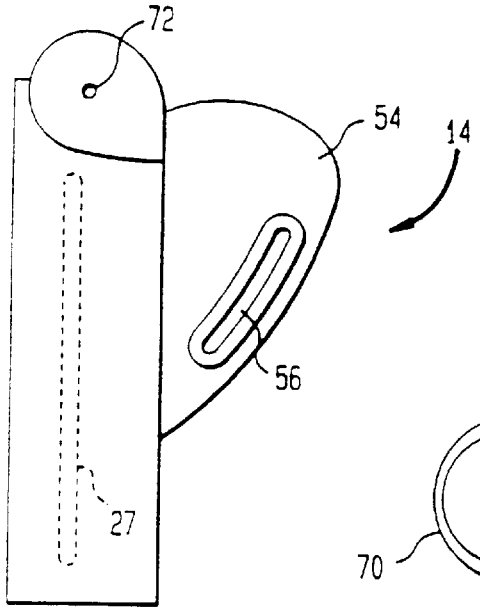
FIG. 5 is a side elevational view of the height adjustment member.

Height adjustment member 14 is cooperable with the third element of the keyboard support apparatus, namely, the horizontal mounting member 16. As illustrated in FIG. 1 and FIG. 5, a side view of height adjustment member 14, each of the parallel side bracket members 40 and 42 have extending rearwardly therefrom, an upstanding arcuate member 54 in parallel relationship with each other, each member 54 having an arcuate slot 56 formed therein, slots 56 being in parallel relationship to each other.

Figure 7:
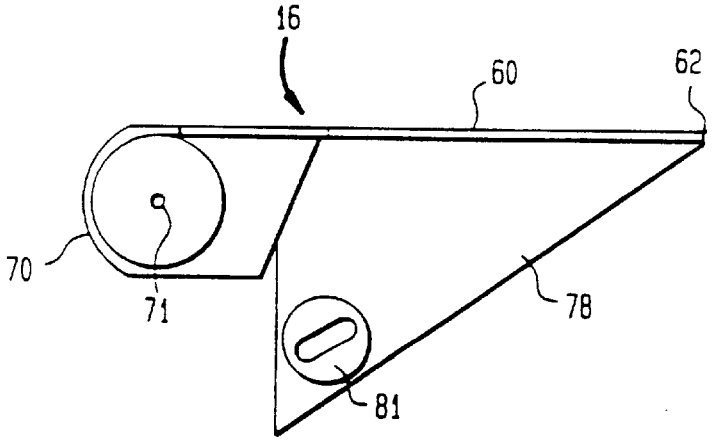
FIG. 7 is a side elevational view of the horizontal mounting member.
Figure 9:
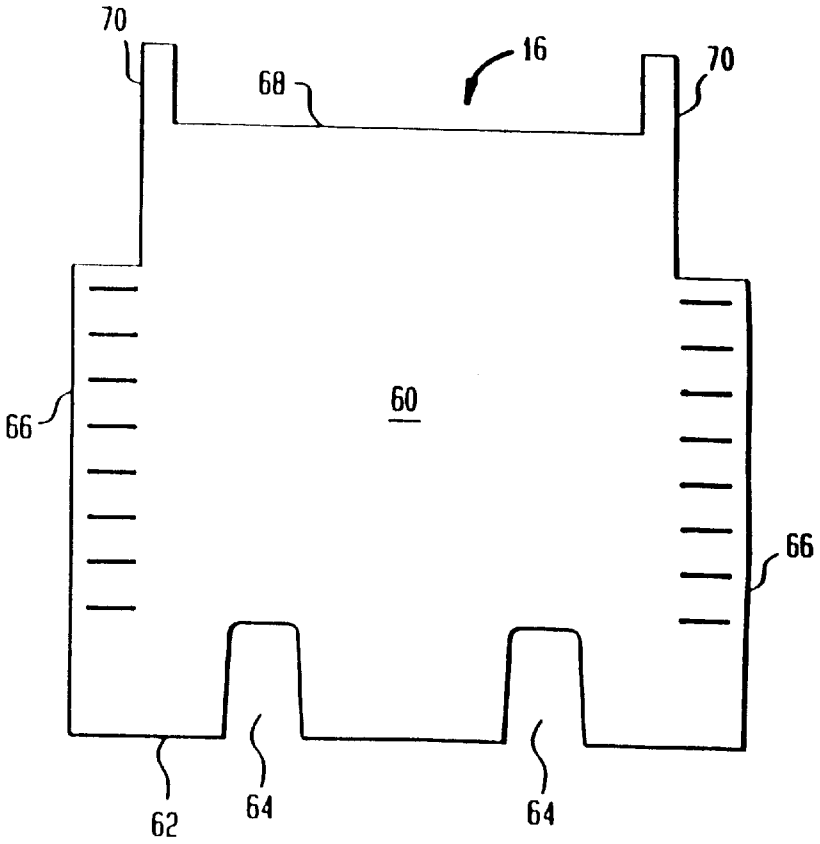
FIG. 9 is a top elevational view of the horizontal mounting member.
Figure 8:
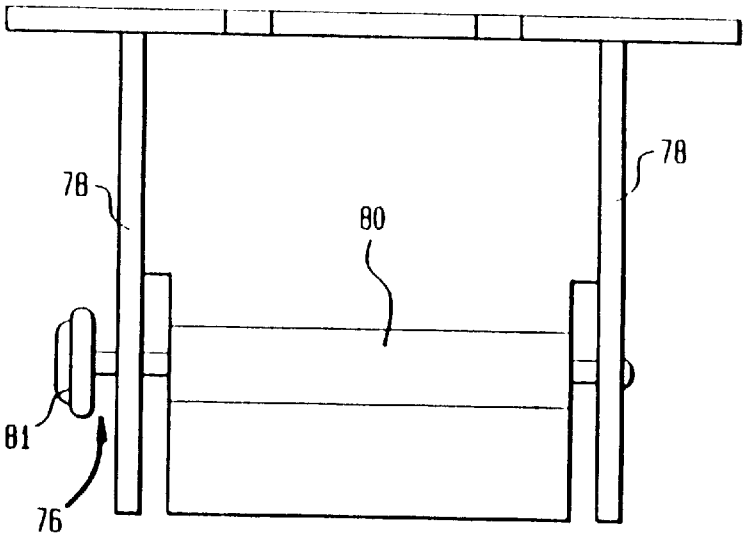
FIG. 8 is a rear elevational view of the horizontal mounting member.

FIGS. 7, 8 and 9 are, respectively, a side view, rear view and top view of horizontal mounting member 16. Horizontal mounting member 16 has a generally planar upper panel 60 for cooperation with the underside of the computer stand or computer table, a pair of downwardly depending triangular side walls 78, and a downwardly depending front wall 79. It may be either mounted directly to the table or cooperable with a tracking system allowing for its slidable engagement under the table. At its rearward edge 62, horizontal upper panel 60 may have a plurality of cutouts 64 for the securing of the mounting member 16 to the underside of the computer table or stand. Alternatively, lateral edges 66 of upper panel 60 could serve to position the horizontal mounting member 16 within a tracking system on the underside of the computer table.

On the forward edge 68 of upper panel 60, horizontal mounting member 16 has two parallel protruding ears 70, each of which has a centrally disposed aperture 71. Ears 70 are spaced apart so as to fit in recessed corners 73 at the upper lateral edges of height adjustment member 14. In assembled position, apertures 71 in horizontal mounting member 16 are aligned with an aperture 72 extending through height adjustment member 14 between corners 73. A guide rod extending through apertures 71 and 72 holds height adjustment member 14 and horizontal mounting member 16 in assembled position while at the same time permitting the members to pivot with respect to one another.

Height adjustment member 14 may be locked in place relative to horizontal mounting member 16 by a compression locking system 76 assembled on the downwardly depending side walls 78 of horizontal mounting member 16. Compression locking system 76 includes a guide rod (not shown) which is assembled at one end to one side wall 78, and which then passes in succession through one of the arcuate slots 56 in height adjustment member 14, through an elongated bore 80 formed on the front wall 79 horizontal mounting member 16, through the other arcuate slot 56 on height adjustment member 14, and finally through the other downwardly depending side wall 78. An enlarged finger nut 81 may be threadedly engaged on the free end of the guide rod. Tightening finger nut 81 will compress arcuate members 54 on height adjustment member 14 between through bore 80 and side walls 78 on horizontal mounting member 16, thereby locking the height adjustment member from pivoting relative to the horizontal mounting member. As finger nut 81 is loosened, the compressive force will be diminished so that height adjustment member 14 will be free to pivot relative to horizontal mounting member 16.

The movement of the guide rod within arcuate slot 56 defines the range of this pivotable movement. This pivotable movement provides for fine tuning the angular position of the keyboard support 12 and the keyboard positioned thereon vis-a-vis the operator. This is an active adjustment which is designed to accommodate the extremes and variations in the anthropomeric range indicated below.

| | | | | |
|---|---|---|---|---|
| Popliteal Height: | 5th % Female 360 mm (14.2") | 95th % Male 485 mm (19.5") | Variance 135 mrn (5") | Proformix Height Adj. 135 mrn (5") |
| Elbow to Finger: | 5th % Female 400 mm (15.7") | 95th % Male 515 mm (20.3") | Variance 115 rnm (4.5") | Proformix Adjustment >115 mm (4.5") |
| Hand Length: | 5th % Female 165 mm (6.5") | 95th % Male 210 mm (8.25") | Variance 55 mm (1.75") | Proformix Palm Rest 80 mm (3.13") |

Figure 10:
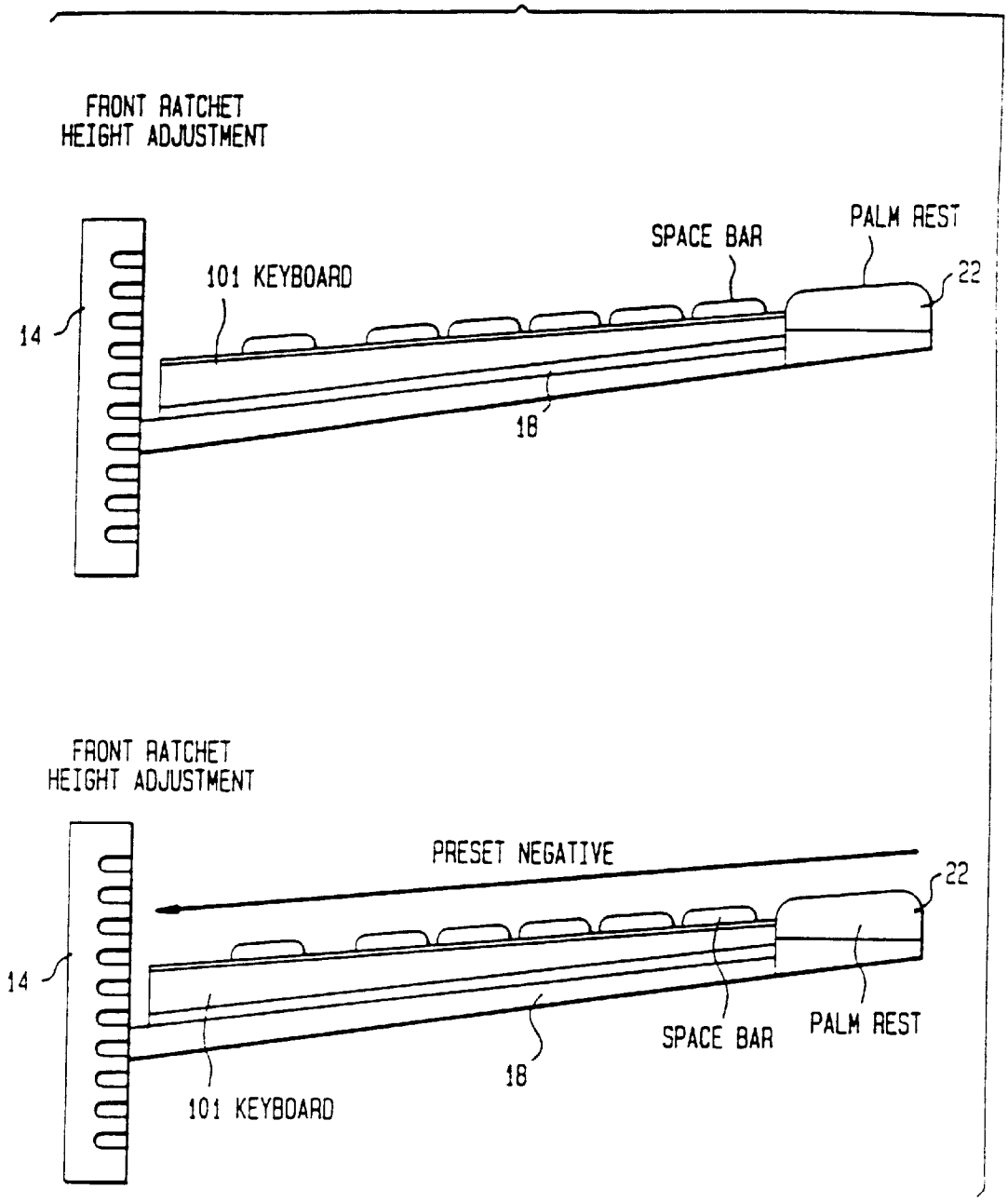
FIG. 10 is a highly schematic side elevational view illustrating the neutral wrist position preset in the keyboard support assembly in order to avoid fatigue, tension and pain.

FIG. 10 illustrates the preset negative angle of the keyboard in order to avoid stress and strain. Keyboard-support 12 is cooperative with height adjustment member 14 in a ratchet arrangement in order to selectively adjust the height. Another feature of the keyboard support 12, in order to further reduce stress, strain and tension on the fingers, wrist and forearms, is the non-skid, friction support pad 13 positioned on the upper surface of planar support base 18. The keyboard support 12 would come with several non-skid friction support pads 13 of various thicknesses. The operator would choose the non-skid pad 13 of such thickness to ensure that the upper surface of the keyboard keys is aligned with the upper surface of palm rest 22. In this configuration, the upper surface of the keys would be on the same plane and at the same height as the palm rest.

As seen in FIG. 10, the conventional keyboard 101 is shown supported on the planar support base 18. As is well known, the keyboard has a space bar located along a forward edge and a plurality of keys. The space bar and keys are disposed generally directed upwardly. As shown, the forward edge of the keyboard near the space bar is disposed along palm rest 22. As is well known, the keys carry indicia thereon such as numbers and letters and the indicia are disposed on the keys such that the bottoms of the letters are closer to the forward edge of the keyboard than the tops of the letters and the tops of the letters are closer to the rear end of the keyboard than the bottoms of the letters. This is to say, as is well known, the letters on the keys are oriented for normal reading by viewing rearwardly over the forward edge, that is, viewing downwardly and from the right to the left as seen in FIG. 10.

The operator can reference a laminated instructional card which details the adjustments available to the operator. This laminated card is slidably cooperable with horizontal mounting member 16 so as to be recessed under the computer stand or work surface when not in use, but slidably removable by the operator in order to reference correct settings.

The ergonomic keyboard support assembly 10 when properly installed and adjusted provides a work area in which the operator is seated with the feet firmly on the floor and slightly ahead of the knees. This leg position facilitates the unrestricted blood circulation in the legs with the feet supporting the weight of the lower legs. The chair height is adjusted to make the thighs nearly parallel to the floor as possible. This again avoids pressure behind the knees and promotes good blood circulation through the legs.

The operator would sit rearwardly in the chair, tilted slightly from 90° vertical and well supported in the lumbar region thereby opening the body angle at the hip. This angle reduces disk pressure and relieves the muscles of the back from holding the body perfectly upright, a position that cannot be maintained for long periods of time.

The head would be balanced, the shoulders relaxed and the arms hanging naturally so that the hands rest comfortably on the lap. This creates an open angle at the elbow joint, again providing for proper circulation.

This seated posture allows for the ergonomic keyboard support assembly 10 to actually bring the work surface to the operator. It positions the keyboard lower, close to the lap where the arms can hang naturally with open angles at the elbow. The ergonomic keyboard support assembly 10 supports the weight of the arms and keeps the wrists and hands straight and relaxed in what is referred to as a "wrist neutral position". This is accomplished by the negative angle of the keyboard support which slopes away from the user. The preset negative slope causes the hands to fall naturally into the wrist neutral position.

The palm rest supports the fleshy portion of the hand and palm and presents a surface which allows the hands to glide freely from one end of the keyboard to the other without sticking.

The ergonomic keyboard support assembly, which is the subject matter of this application, provides the operator with a comfortable working environment in which proper posture is promoted and in which the hands, wrists and arms of the operator are properly supported and positioned to avoid stress and strain. The ergonomic keyboard support assembly adjusts in order to bring the work, in the form of the keyboard, to the operator while the operator maintains the proper posture. While the ergonomic keyboard support assembly of the present application allows for certain adjustments to accommodate anatomical differences between operators, certain adjustments are preset, such as the negative slope of the keyboard support, so that a wrist neutral position is maintained. This negative slope is maintained regardless of the height adjustments which may be needed to accommodate anatomical differences between the operators.

While the present invention has been described in connection with the exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

What is claimed is:

1. In a workstation having a keyboard and an adjustable support assembly for supporting the keyboard, the support assembly comprising a support platform having an upper surface, a front edge and a rear edge, the keyboard having a space bar along a forward edge of the keyboard and upwardly facing indicia carrying keys with indicia thereon oriented for normal reading by viewing rearwardly over the forward edge, the keyboard located on the upper surface of the support platform with the forward edge of the keyboard directed toward the front edge of the support platform, the support assembly including a bracket assembly for mounting the support platform to the workstation, the support assembly including a bracket assembly for mounting the support platform to the workstation, the support platform being movably mounted to the bracket assembly for movement through a range of positions including angular movement of said support platform relative to said bracket assembly to locate the front and rear edges of the support platform at different heights relative to each other, a locking mechanism for locking said support platform in fixed relation to said bracket assembly within said range of positions, the improvement comprising a limiting mechanism for limiting angular movement of said support platform relative to said bracket assembly so that said support platform in a locked condition is always oriented with said front edge higher than said rear edge.

2. A workstation as claimed in claim 1 wherein said bracket assembly comprises a first bracket element mounted to the workstation, a second bracket element pivotably mounted to the first bracket element for pivoting about a horizontal axis, the support platform mounted to the second bracket element for adjustment of the distance of the support platform from the horizontal axis.

3. A workstation as claimed in claim 2 wherein limit stop members carried on the first bracket element and on the second bracket element spaced from the axis engage each other to limit pivoting of the second bracket element relative the first bracket element through a range in which the front edge of the support platform is higher than the rear edge.

4. A workstation as claimed in claim 3 including a first lock mechanism releasably locking the first bracket element and second bracket element against pivoting about the axis.

5. A workstation as claimed in claim 4 including a second lock mechanism releasably locking the support platform to the second bracket element.

6. In combination, a keyboard and a support mechanism supporting the keyboard, the support mechanism comprises:

a bracket member adapted to be fixedly mounted relative to a work surface, a support tray movably mounted to said bracket member, said support tray comprising a support surface, the keyboard having an upper surface with a forward edge and a rear edge, the upper surface of the keyboard having keys carrying letters, each letter having a top and a bottom, when viewed in a normal manner the bottoms of the letters located closer to a forward edge of the keyboard than the tops of the letters and the tops of the letters located closer to the rear edge of the keyboard than the bottoms of the letters, the keyboard disposed on the support surface with the keys directed upwardly, said support tray being movable to a range of positions in which said relative height of said forward edge of the keyboard varies relative the relative height of said rear edge of the keyboard, a locking mechanism having a locked condition for locking said support tray in fixed relationship to said bracket member within said range of positions, a limit mechanism limiting movement of the support tray relative to said bracket member so that said support tray in a locked condition is always oriented with said forward edge of the keyboard at a vertical height relative to said rear edge of the keyboard higher than the rear edge of the keyboard.

7. A method of positioning a keyboard with respect to a work surface, the keyboard having a space bar along a forward edge of the keyboard and upwardly facing indicia carrying keys with indicia thereon oriented for normal reading by viewing rearwardly over the forward edge, said method comprising the steps of:

mounting said keyboard on a support platform having a front edge and a rear edge with the forward edge of the keyboard directed toward the front edge of the support platform, moving said support platform relative to said work surface through a range of positions between a lower position and an upper position;

locking said support platform at one of a plurality of selected position within said range of positions; and limiting angular movement of said support platform relative to said work surface in each of said plurality of selected position so that said support platform in any one of said plurality of selected position is always oriented with said front edge higher than said rear edge.

8. The method as claimed in claim 7, further comprising the steps of pivoting said support platform relative to said work surface through a predetermined range of angles, and locking said support platform in fixed angular relationship relative to said work surface within said predetermined range of angles.

9. The method as claimed in claim 7, further comprising the steps of providing a palm rest along said front edge of said support platform, said palm rest having a support surface located at a spaced distance above said upper surface of said support platform, and mounting said keyboard on said support platform so that a top of the forward edge of said keyboard is at said spaced distance above said upper surface of said support platform in alignment with said support surface of said palm rest.

10. A method for positioning a keyboard with respect to a work surface the keyboard having a space bar alone a forward edge of the keyboard and upwardly facing indicia carrying keys with indicia thereon orientated for normal reading by viewing rearwardly over the forward edge, said method comprising the steps of:

mounting said keyboard on a support platform having an upper surface extending generally in a plane, a front edge and a rear edge, with the forward edge of the keyboard adjacent and directed toward the front edge of the support platform;

moving said support platform in a first direction transverse to said plane through a range of positions between a lower position and an upper position;

moving said support platform in a second direction different from said first direction between a retracted position in which said front edge of said support platform is at a first spaced distance from said work surface and an extended position in which said front edge of said support platform is at a spaced distance from said work surface greater than said first spaced distance;

locking said support platform at a selected position within said range of positions; and limiting angular movement of said support platform relative to said work surface in said selected position so that said support platform in said selected position is always oriented with said front edge higher than said rear edge.

11. The method as claimed in claim 10, further comprising the steps of pivoting said support platform relative to said work surface through a predetermined range of angles, and locking said support platform in fixed angular relationship relative to said work surface within said predetermined range of angles.

12. The method as claimed in claim 10, further comprising the steps of providing a palm rest along said front edge of said support platform, said palm rest having a support surface located at a spaced distance above said upper surface of said support platform, and mounting said keyboard on said support platform so that a top front edge of said keyboard is at said spaced distance above said upper surface of said support platform in alignment with said support surface of said palm rest.

* * * * *

UNITED STATES PATENT AND TRADEMARK OFFICE

CERTIFICATE OF CORRECTION

PATENT NO. : 6,148,739

DATED : November 21, 2000

INVENTOR(S) : Martin

It is certified that error appears in the above-identified patent and that said Letters Patent is hereby corrected as shown below:

Column 5, line 24, "clevational" should read - - elevational - - .

Column 11, line 28, "alone" should read - - along - - .

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*